US008451178B2

(12) United States Patent
Sakai

(10) Patent No.: US 8,451,178 B2
(45) Date of Patent: May 28, 2013

(54) ANTENNA

(75) Inventor: Hiroto Sakai, Niiza (JP)

(73) Assignee: Honda Access Corp., Niiza-shi, Saitama (JP)

( * ) Notice: Subject to any disclaimer, the term of this patent is extended or adjusted under 35 U.S.C. 154(b) by 427 days.

(21) Appl. No.: 12/949,895

(22) Filed: Nov. 19, 2010

(65) Prior Publication Data

US 2011/0128188 A1 Jun. 2, 2011

(30) Foreign Application Priority Data

Nov. 30, 2009 (JP) ..... 2009-272064

(51) Int. Cl.
*H01Q 1/38* (2006.01)

(52) U.S. Cl.
USPC ..... 343/700 MS; 343/702

(58) Field of Classification Search
USPC ..... 343/700 MS, 702, 846, 848
See application file for complete search history.

(56) References Cited

U.S. PATENT DOCUMENTS 6,535,167 B2 * 3/2003 Masuda et al. ..... 343/700 MS
7,755,545 B2 * 7/2010 Takei et al. ..... 343/702

FOREIGN PATENT DOCUMENTS

JP 07-288415 A 10/1995

OTHER PUBLICATIONS

Professor Yamada et al.; "Small sized antenna and system application"; Publisher : K-Laboratory publishing, pp. 40-41.

* cited by examiner

*Primary Examiner* — Hoang V Nguyen
(74) *Attorney, Agent, or Firm* — Westerman, Hattori, Daniels & Adrian, LLP

(57) ABSTRACT

There is provided an antenna small in its size but capable of achieving sufficient gain. The antenna comprises antenna elements connected to a power source. The antenna elements comprise upstanding vertical sections connected to the power source and horizontal sections substantially parallel with a ground pattern and having one end thereof connected to an end portion of the vertical sections. The antenna elements further comprise short stubs provided away from the vertical sections toward the other end of the horizontal sections and connected to the ground pattern, and open-ended open stubs provided away from the short stubs toward the other end of the horizontal sections and extending from the horizontal sections toward the ground pattern. The antenna elements are made of a metal foil and are provided on an antenna board.

7 Claims, 3 Drawing Sheets

ANTENNA

BACKGROUND OF THE INVENTION

1. Field of the Invention

The present invention relates to an antenna suitable for use in radio communication of a wireless starting system or the like for a vehicle.

2. Description of Related Art

Conventionally, an antenna employing a monopole antenna has been used for performing radio communication of a wireless starting system or the like for a vehicle. However, since such monopole antenna as a whole tends to be long in one direction, there has been provided a small-sized inverted-L antenna manufactured by bending the monopole antenna.

In such inverted-L antenna, a capacitive reactance component is generated between a ground surface of a circuit board and a horizontal section of an antenna element parallel with the ground surface. When the height of the horizontal section of such inverted-L antenna is low, the impedance of the antenna decreases, thereby causing the impedance difference to be matched to increase, thus making it difficult to perform impedance matching with respect to a feeder of 50Ω. Also, when the impedance difference to be matched becomes large, the loss on a matching circuit inserted between the feeder and the antenna element increases, thus impairing the efficiency of the antenna.

As described in Laid-open Japanese patent publication No. Hei 07-288415 and "small-sized antenna and system application" (page 40, page 41), by K-Laboratory publishing, there has been provided an inverted-F antenna aimed to facilitate impedance matching between an antenna element and the feeder of 50Ω. In such inverted-F antenna, a horizontal section is connected to a vertical section rising from a ground surface, and a vertical stub is provided in the vicinity of the vertical section, such that electricity is supplied to an end portion of the vertical stub. In this way, the effect of capacitance due to the reactance component is cancelled, thereby making it easy to perform impedance matching with respect to the feeder of 50Ω and reducing the loss generated on the matching circuit.

SUMMARY OF THE INVENTION

However, according to such conventional inverted-L antenna and inverted-F antenna, there are problems that sufficient antenna gain cannot be achieved when the height of the horizontal section is low, preventing radio waves from being emitted therefrom.

It is an object of the present invention to provide an antenna small in its size but capable of achieving sufficient antenna gain.

The present invention employed the following means to solve the aforementioned problems. More specifically, the present invention is an antenna comprising an antenna element connected to a power source, in which the antenna element comprises: an upstanding vertical section connected to the power source; a horizontal section substantially parallel with a ground pattern and having one end thereof connected to an end portion of the vertical section; a short stub provided away from the vertical section toward the other end of the horizontal section and extending from the horizontal section so as to be connected to the ground pattern; and an open-ended open stub provided away from the short stub toward the other end of the horizontal section and extending from the horizontal section toward the ground pattern. In this case, the antenna element may be made of a metal foil and provided on an antenna board. Further, a plurality of the open stubs may be provided.

The antenna of the present invention can reduce impedance difference to be matched by a matching circuit by employing a short stub and an open stub, thereby making it possible to reduce the loss on the matching circuit and achieve sufficient antenna gain despite the size of the antenna being small.

DETAILED DESCRIPTION OF THE INVENTION

Figure 1:
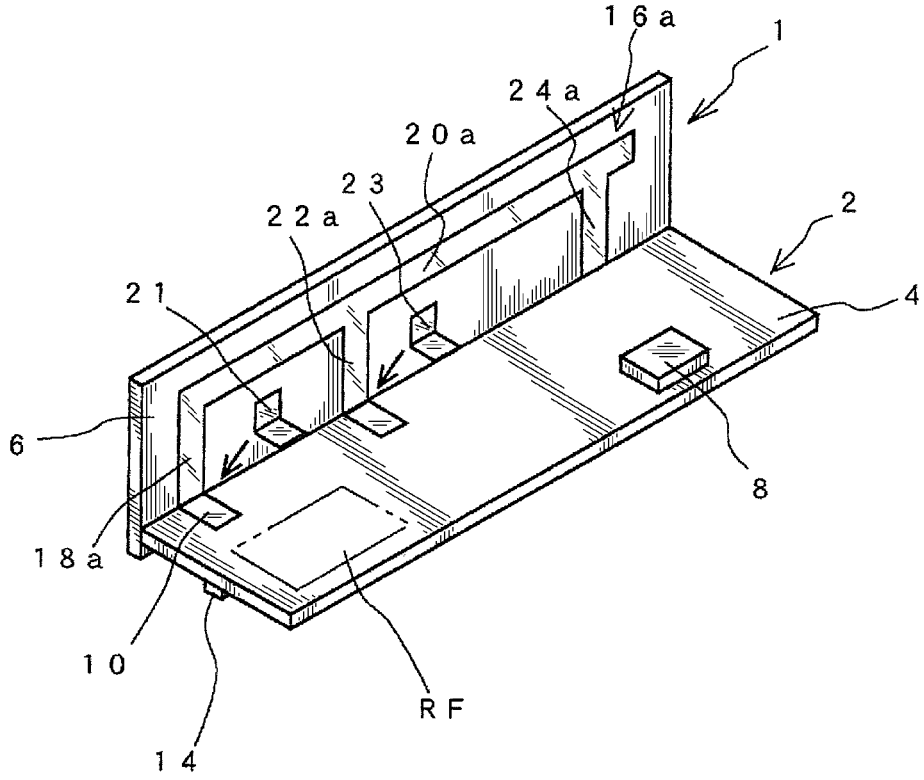
FIG. 1 is a perspective view showing a wireless starting system employing an antenna of an embodiment of the present invention.
Figure 2:
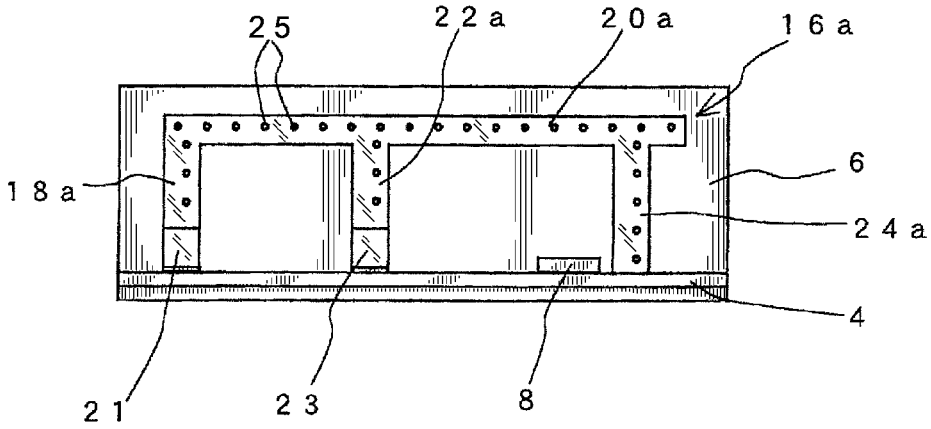
FIG. 2 is a front view showing the wireless starting system employing the antenna of the embodiment of the present invention.
Figure 3:
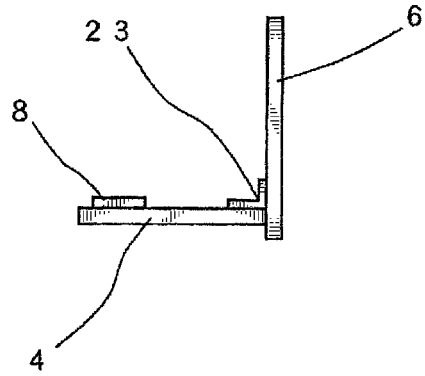
FIG. 3 is a side view showing the wireless starting system employing the antenna of the embodiment of the present invention.
Figure 4:
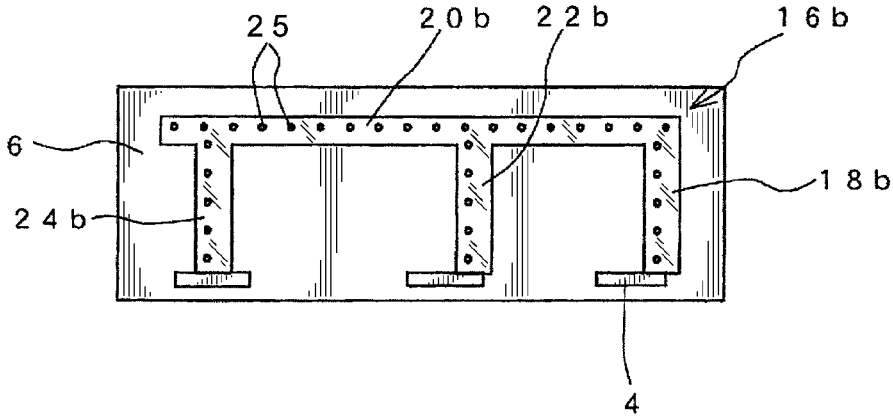
FIG. 4 is a rear view showing the wireless starting system employing the antenna of the embodiment of the present invention.

An embodiment of the present invention is described in detail hereunder with reference to the accompanying drawings. An antenna 1 according to the present embodiment is suitable for use in a wireless starting system 2 mounted on a vehicle or the like. As shown in FIG. 1, the wireless starting system 2 comprises a circuit board 4 and an antenna board 6.

Here, the wireless starting system 2 is a system that allows a driver to wirelessly lock or unlock the doors and tailgate, etc of a vehicle, and start the engine thereof by wirelessly matching an ID code between a receiving device disposed on the main body of the vehicle and a key called keyless operation key. The keyless operation key has a radio communication function, and the driver is only required to carry the keyless operation key and enter a wireless operation range of the vehicle in order to effect the matching of the aforementioned ID code (so-called keyless entry system). The antenna 1 is suitable for use not only in the wireless starting system 2, but also in other wireless systems.

Circuits such as a radio communication circuit RF and a CPU 8 are formed on the upper surface and under surface of the circuit board 4. A feed point 10 is provided on the circuit board 4, and a power source 12 (see FIG. 5) is connected to the feed point 10 via a feeder of 50Ω (not shown). Further, a matching circuit 14 is provided on the under surface of the circuit board 4 for performing impedance matching between the antenna 1 and the feeder, said matching circuit 14 being connected to the power source 12 and the antenna 1.

The circuit board 4 and the antenna board 6 are connected perpendicularly to each other. Antenna elements 16*a*, 16*b* are patterned on a front side of the antenna board 6 facing the circuit board 4 and a back side thereof opposite to the front side thereof, respectively, by a metal foil. Such antenna elements 16*a*, 16*b* patterned on the front and back sides of the antenna board 6 share an identical shape, and are laid one on top of another across the antenna board 6. However, the present invention is not limited to the configuration in which the circuit board 4 and the antenna board 6 are connected perpendicularly to each other. The circuit board 4 and the antenna board 6 may be formed into a flat single substrate. Further, the present invention is not limited to the configuration in which the antenna elements 16*a*, 16*b* are patterned on both the front and back sides of the antenna board 6. The antenna elements 16*a*, 16*b* may be patterned only on one side of the antenna board 6.

The antenna elements 16*a*, 16*b* comprise vertical sections 18*a*, 18*b* vertically upstanding in the vicinity of the feed point 10, and horizontal sections 20*a*, 20*b* substantially parallel to a ground pattern (not shown) formed on the circuit board 4 and formed at a predetermined height from the ground pattern, said horizontal sections 20*a*, 20*b* having one end thereof connected to an end portion of the vertical sections 18*a*, 18*b*. The other end of the horizontal sections 20*a*, 20*b* formed away from the vertical sections 18*a*, 18*b* is an open end. Further, the vertical sections 18*a*, 18*b* are connected to the feed point 10 via an L-shaped bracket 21.

Furthermore, the antenna elements 16*a*, 16*b* comprise short stubs 22*a*, 22*b* vertically extending from the horizontal sections 20*a*, 20*b* toward the circuit board 4. The short stubs 22*a*, 22*b* are connected and short-circuited to the ground pattern of the circuit board 4 via an L-shaped bracket 23. The short stubs 22*a*, 22*b* are formed in the vicinity of the vertical sections 18*a*, 18*b* and a distance (a) away from the vertical sections 18*a*, 18*b* toward the open end side of the horizontal sections 20*a*, 20*b* (see FIG. 5).

Furthermore, the antenna elements 16*a*, 16*b* comprise open stubs 24*a*, 24*b* vertically extending from the horizontal sections 20*a*, 20*b* toward the circuit board 4. An end portion of the open stubs 24*a*, 24*b* facing the circuit board 4 is an open end. The open stubs 24*a*, 24*b* are formed away from the short stubs 22*a*, 22*b* toward the open end side of the horizontal sections 20*a*, 20*b*. However, at the same time, such open stubs 24*a*, 24*b* are also formed away from the open end side of the horizontal sections 20*a*, 20*b* toward the short stubs 22*a*, 22*b*. In the present embodiment, the open stubs 24*a*, 24*b* are formed in a position that is a distance of (c) away from the vertical sections 18*a*, 18*b* toward the open end side of the horizontal sections 20*a*, 20*b* (see FIG. 5).

According to the present embodiment, the two vertical sections 18*a*, 18*b*, the two horizontal sections 20*a*, 20*b*, the two short stubs 22*a*, 22*b*, and the two open stubs 24*a*, 24*b*, are connected to one another via a plurality of through holes 25 on both the front and back sides of the antenna board 6.

The antenna elements 16*a*, 16*b* thus formed resonate while acting as an excitation element. In this case, when target frequency is f, and a wavelength corresponding to such frequency f is λ, a path length that is the sum of the length of the vertical sections 18*a*, 18*b* and the length of the horizontal sections 20*a*, 20*b* is preferably 10-40% of the wavelength λ.

Figure 5:
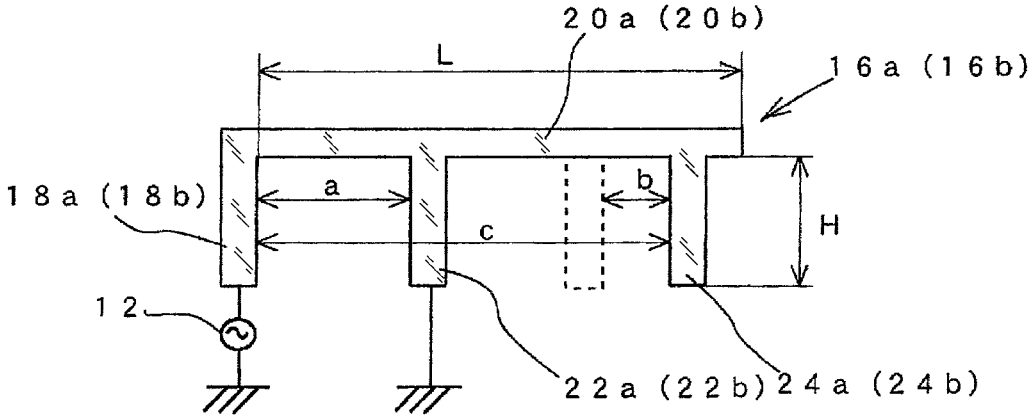
FIG. 5 is an explanatory diagram showing a structure of the antenna of the present embodiment.
Figure 6:
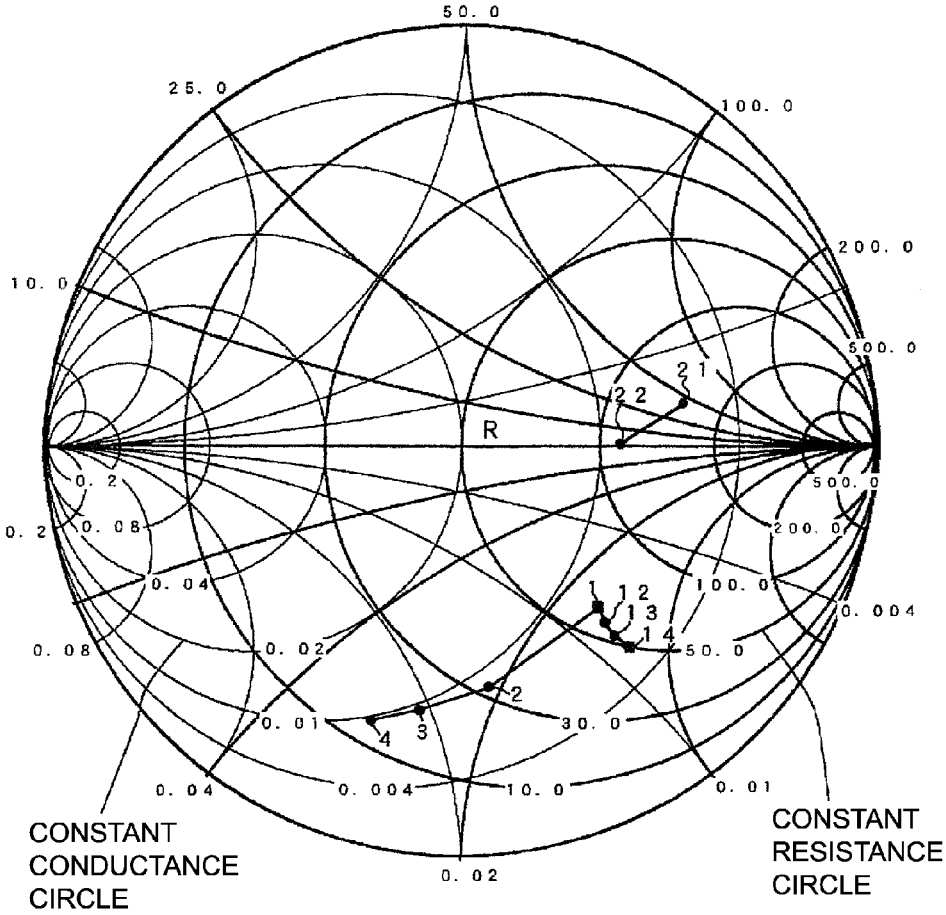
FIG. 6 is an immittance chart concerning the input impedances of the antenna of the present embodiment.

FIG. 6 is an immittance chart concerning the input impedances of the antenna 1. According to the present embodiment, as shown in FIG. 5, the width of each pattern of the vertical sections 18*a*, 18*b*, the horizontal sections 20*a*, 20*b* and the open stubs 24*a*, 24*b* is 3 mm, and the width of the pattern of the short stubs 22*a*, 22*b* is 4 mm. Further, a length L of the horizontal sections 20*a*, 20*b* is 119 mm, and a height H of the vertical sections 18*a*, 18*b*, the short stubs 22*a*, 22*b* and the open stubs 24*a*, 24*b* is 21 mm, respectively.

Furthermore, the distance (c) between the vertical sections 18*a*, 18*b* and the open stubs 24*a*, 24*b* is 109 mm, and the distance (a) between the vertical sections 18*a*, 18*b* and the short stubs 22*a*, 22*b* is 20 mm. Such distance (a) was further varied to 30 mm, 40 mm and 50 mm, and input impedances corresponding to each one of these values of the distance (a) were then obtained. The impedances thus obtained are shown in a table 1, and the "No." in the table 1 corresponds to the numbers shown in the immittance chart. Here, "j" denotes an imaginary unit.

TABLE 1

| No. | Distance a | Input impedance | Q value (429.225 MHz) |
|---|---|---|---|
| 1 | 20 mm | 61.000 – j65.000 Ohm | 1.066 |
| 2 | 30 mm | 27.200 – j48.200 Ohm | 1.772 |
| 3 | 40 mm | 17.500 – j39.300 Ohm | 2.246 |
| 4 | 50 mm | 13.100 – j34.500 Ohm | 2.634 |

Points 1 through 4 are shown in the immittance chart of FIG. 6, concerning the input impedances corresponding to the various values of the distance (a) between the vertical sections 18*a*, 18*b* and the short stubs 22*a*, 22*b*. By varying the distance (a) between the vertical sections 18*a*, 18*b* and the short stubs 22*a*, 22*b*, it was found that the shorter the distance (a) was, the larger a step-up ratio of the impedance (an incremental ratio of impedance) became, and the smaller the Q value became, thus widening the bandwidth of the antenna 1.

By providing the short stubs 22*a*, 22*b*, the impedance is allowed to step up, thereby reducing the impedance difference to be matched by the matching circuit 14, thus reducing the loss on the matching circuit 14, and improving the antenna gain. Further, the antenna gain improved by 1-2 dB with the presence of the open stubs 24*a*, 24*b*, as compared to a configuration in which no open stub is provided.

Next, other positions of the open stubs 24*a*, 24*b* were considered by providing the open stubs 24*a*, 24*b* closer to the short stubs 22*a*, 22*b*, while fixing the distance (a) between the vertical sections 18*a*, 18*b* and the short stubs 22*a*, 22*b* to 20 mm. A varying distance (b) is the distance between the original position of the open stubs 24*a*, 24*b* and a new position thereof to be considered shown by broken lines in FIG. 5. The varying distance (b) was varied to 20 mm, 30 mm and 40 mm, and the input distances were then obtained with respect to each one of these values of the distance (b). The impedances thus obtained are shown in a table 2.

TABLE 2

| No. | Distance b | Input impedance | Q value (429.225 MHz) |
|---|---|---|---|
| 1 | 0 mm | 61.000 – j65.000 Ohm | 1.066 |
| 12 | 20 mm | 54.902 – j75.315 Ohm | 1.372 |
| 13 | 30 mm | 51.431 – j83.597 Ohm | 1.625 |
| 14 | 40 mm | 48.993 – j90.841 Ohm | 1.854 |

Points 12 through 14 are shown in the immittance chart of FIG. 6, concerning the input impedances corresponding to each new position of the open stubs 24*a*, 24*b* to be considered. When the open stubs 24*a*, 24*b* were positioned closer to the short stubs 22*a*, 22*b* by namely increasing the distance b, the resistance value of the impedance decreased while the imaginary value (reactance value) of the impedance increased. The imaginary value (reactance value) of the impedance significantly increased when the distance (b) was increased, thereby increasing the impedance difference to be matched, thus making it difficult to perform impedance matching. Further, at that time, the impedance difference to be matched by the matching circuit 14 increased, thereby increasing the loss on the matching circuit 14, thus decreasing the gain of the antenna 1. Furthermore, at that time, the Q value increased, thereby narrowing the bandwidth of the antenna 1.

Figure 7:
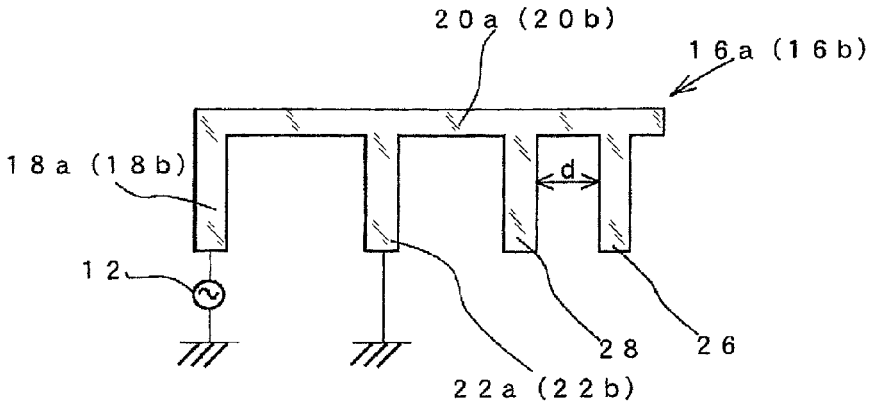
FIG. 7 is an explanatory diagram showing a structure of an antenna of another embodiment.

In addition, the resistance value of the impedance can be further increased and the imaginary value (reactance value) of the impedance can be reduced to zero by providing a plurality of open stubs 26, 28, for example, two, as shown in FIG. 7, and by regulating the positions of the short stubs 22*a*, 22*b* and the open stubs 26, 28 as well as the intervals between the short stubs 22*a*, 22*b* and the open stubs 26, 28. A varying distance (d) between the two open stubs 26, 28, as shown in FIG. 7, is varied to 40 mm and 35 mm, and the input impedances obtained with respect to each varying distance (d) are shown in a table 3.

TABLE 3

| No. | Distance b | Input impedance | Q value (429.225 MHz) |
|---|---|---|---|
| 21 | 40 mm | 152.000 + j41.000 Ohm | 0.270 |
| 22 | 35 mm | 115.000 + j1.000 Ohm | 0.009 |

The resistance value of the impedance can be increased, and the imaginary value (reactance value) of the impedance can be reduced to zero by regulating the distance (d) between the two open stubs 26, 28. In this way, the gain of the antenna can be further improved. The gain of the antenna can be improved by 3 dB or more with the presence of the two open stubs 26, 28, as compared to a configuration in which no open stub is provided.

The short stubs 22*a*, 22*b* and the open stubs 24*a*, 24*b*, 26, 28 are provided away from the vertical sections 18*a*, 18*b* toward the open end side of the horizontal sections 20*a*, 20*b*, thereby making it easy to ensure a proper distance between the radio communication circuit RF and the CPU 8 or the like by disposing the radio communication circuit RF on an end side of the circuit board 4, even when both the radio communication circuit RF and the CPU 8 or the like are provided on the same circuit board 4. Such a configuration makes it easy for the CPU 8 or the like to be less affected by the noise produced by the radio communication circuit RF.

Further, in an inverted-L antenna or an inverted-F antenna, when the height of a horizontal section is low, radio waves are barely emitted therefrom, but almost only emitted from a vertical section, thus causing vertically-polarized waves to become dominant. As described in the present embodiment, the gain of the antenna 1 can be improved by providing one or a plurality of the open stubs 24*a*, 24*b*, 26 and 28.

According to the present embodiment, horizontally-polarized waves can be emitted from the horizontal sections 20*a*, 20*b* by appropriately regulating the height thereof, and vertically-polarized waves are emitted from the vertical sections 18*a*, 18*b*, the short stubs 22*a*, 22*b*, and the open stubs 24*a*, 24*b*, 26, 28. In this sense, the radio field strength of the horizontally-polarized waves and the radio field strength of the vertically-polarized waves can even be rendered to be equal to one another by regulating the amount of the vertically-polarized waves or the height of the horizontal sections 20*a*, 20*b*.

The present invention is not limited to the aforementioned embodiment. Various embodiments are possible without departing from the spirit and scope of the present invention.

What is claimed:

1. An antenna comprising:

an antenna element connected to a power source;

a vertical section connected to said power source and being upstanding;

a horizontal section substantially parallel with a ground pattern and having one end thereof connected to an end portion of said vertical section;

a short stub provided away from said vertical section toward an other end of said horizontal section and extending from said horizontal section so as to be connected to said ground pattern; and an open-ended open stub provided away from said short stub toward said other end of said horizontal section and extending from said horizontal section toward said ground pattern.

2. The antenna according to claim 1, wherein said antenna element is made of a metal foil and is provided on an antenna board.

3. The antenna according to claim 2, wherein a plurality of said open stubs are provided.

4. The antenna according to claim 2, wherein said other end of said horizontal section is an open end, and said short stub and said open stub are provided away from said vertical section toward said open end of said horizontal section.

5. The antenna according to claim 1, wherein a plurality of said open stubs are provided.

6. The antenna according to claim 5, wherein said other end of said horizontal section is an open end, and said short stub and said open stub are provided away from said vertical section toward said open end of said horizontal section.

7. The antenna according to claim 1, wherein said other end of said horizontal section is an open end, and said short stub and said open stub are provided away from said vertical section toward said open end of said horizontal section.

* * * * *